US009536455B2

(12) United States Patent
Benasillo

(10) Patent No.: US 9,536,455 B2
(45) Date of Patent: Jan. 3, 2017

(54) UNIVERSAL SIGNAGE FRAME KIT FOR A POINT OF PURCHASE INTERFACE SUCH AS A SPEAKER POST

(71) Applicant: Visual Graphic Systems Inc., Carlstadt, NJ (US)

(72) Inventor: Patrick Benasillo, Carlstadt, NJ (US)

(73) Assignee: VISUAL GRAPHIC SYSTEMS INC., Carlstadt, NJ (US)

( * ) Notice: Subject to any disclaimer, the term of this patent is extended or adjusted under 35 U.S.C. 154(b) by 66 days.

(21) Appl. No.: 14/692,454

(22) Filed: Apr. 21, 2015

(65) Prior Publication Data

US 2016/0314724 A1 Oct. 27, 2016

(51) Int. Cl.
*G09F 7/18* (2006.01)
*G09F 7/20* (2006.01)

(52) U.S. Cl.
CPC ..... *G09F 7/20* (2013.01); *G09F 2007/1843* (2013.01); *G09F 2007/1847* (2013.01)

(58) Field of Classification Search
CPC G09F 15/0012; G09F 7/18; G09F 2007/1843; G09F 15/0018; Y10T 29/49826; F16M 13/02; F16M 2200/08; F16M 11/24; F16M 11/00; F16M 11/04
USPC ..... 40/610, 729
See application file for complete search history.

(56) References Cited

U.S. PATENT DOCUMENTS 1,627,211 A * 5/1927 Stewart ..... G09B 1/00 40/610
2,790,258 A * 4/1957 Freshour ..... G09F 15/0068 160/135
3,972,140 A * 8/1976 Casparro ..... G09F 11/12 198/686
4,001,987 A * 1/1977 Coulthard ..... E04B 2/7442 160/135
4,656,766 A * 4/1987 Cooper ..... G09F 15/0068 40/605
4,878,303 A * 11/1989 Banniza ..... G09F 7/20 40/601
5,083,390 A * 1/1992 Edman ..... G09F 7/18 40/607.02
5,277,512 A * 1/1994 Dwillies ..... A47B 47/0041 24/DIG. 53
5,572,821 A * 11/1996 Coleman ..... G09F 15/0025 160/328
5,664,749 A * 9/1997 Kump ..... G09F 15/0012 248/205.3
D384,979 S * 10/1997 Greene, Jr. ..... D20/41
6,393,748 B1 * 5/2002 Cooper ..... G09F 15/0056 248/165
6,668,474 B2 * 12/2003 Winterton ..... G09F 15/00 40/607.1
6,694,896 B1 * 2/2004 Milazzo ..... A47B 1/04 108/115

(Continued)

*Primary Examiner* — Shin Kim
(74) *Attorney, Agent, or Firm* — Leason Ellis LLP

(57) ABSTRACT

A signage frame kit for a point of purchase interface, such as a speaker post, is provided. The signage frame kit includes frame elements that can be retrofitted to an existing point of purchase interface. The frame elements provide not only a means for attaching the frame to the point of purchase interface but also provide a means for receiving signage which can be prominently displayed at the point of purchase interface.

26 Claims, 4 Drawing Sheets

(56) References Cited

U.S. PATENT DOCUMENTS

| | | | | |
|---|---|---|---|---|
| 7,797,869 | B2 * | 9/2010 | Tollis | G09F 7/00 248/156 |
| 7,866,074 | B2 * | 1/2011 | McComb | B43K 23/001 160/135 |
| 9,110,362 | B2 * | 8/2015 | Risher | G03B 21/56 |
| 2009/0249668 | A1 * | 10/2009 | Conway | G09F 7/18 40/611.07 |
| 2014/0026453 | A1 * | 1/2014 | Weis | G09F 15/0012 40/606.15 |
| 2014/0026454 | A1 * | 1/2014 | Weis | G09F 15/00 40/610 |
| 2014/0251841 | A1 * | 9/2014 | Corey | G03B 21/10 206/223 |

* cited by examiner

SECTION A-A

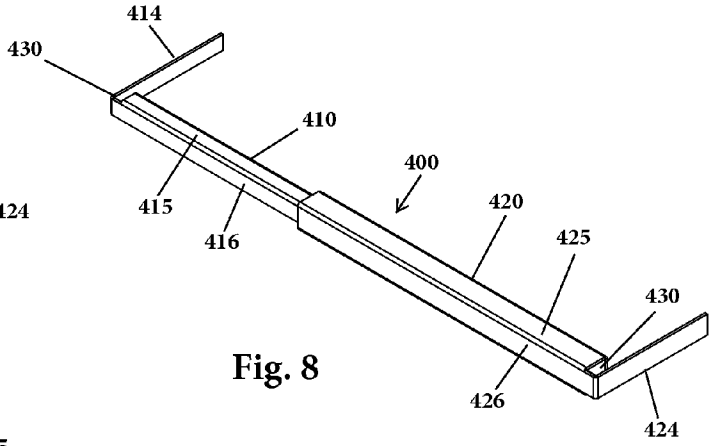
Fig. 8
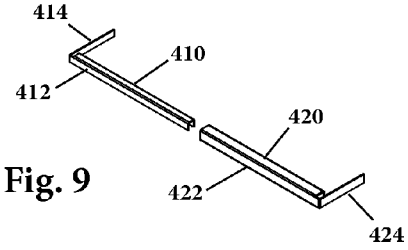
Fig. 9
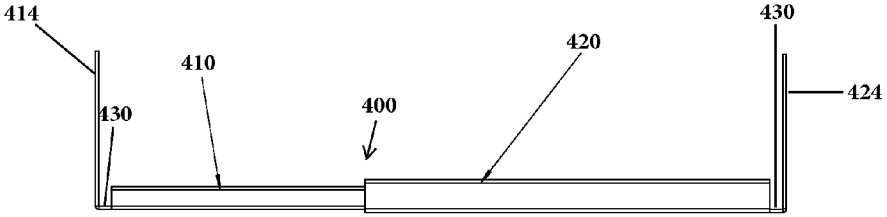
Fig. 10
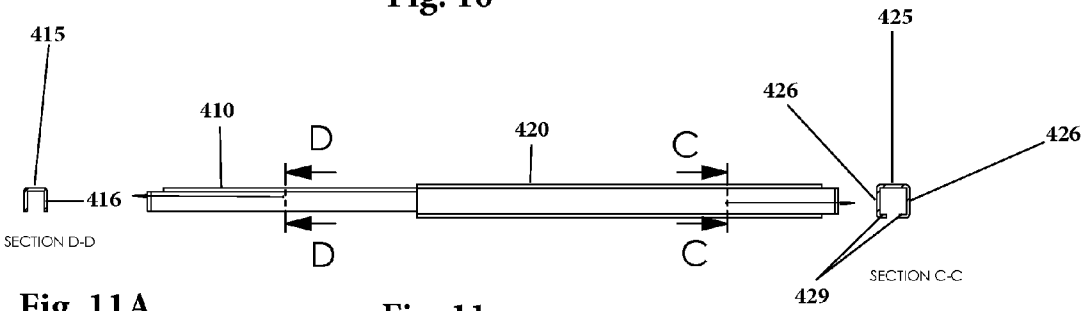
Fig. 11B
Fig. 11
Fig. 11A

UNIVERSAL SIGNAGE FRAME KIT FOR A POINT OF PURCHASE INTERFACE SUCH AS A SPEAKER POST

TECHNICAL FIELD

The present invention is directed to a frame kit for installation relative to an object and more specifically, to a universal signage frame kit for installation at a point of purchase interface and being configured to display signage.

BACKGROUND

A drive-through, or drive-thru, is a type of service provided by a business that allows customers to purchase products without leaving their cars. Orders are generally placed using a microphone and picked up in person at the window. In a drive-thru, cars create a line and move in one direction through a drive-thru lane. Drive-thrus are now found in the vast majority of modern American fast-food chains and also are prominently found in suburban banks.

A typical drive-thru has a number of different components and features that make the consumer's purchasing decision easy and efficient from the time the consumer's car enters the drive-thru to the time that the car leaves the drive-thru. For example, directional signs direct the consumer's car to the drive-thru lane. At some drive-thrus, a presell board is provided and represents the first opportunity to influence and educate the consumer on the offerings. A clearance bar or the like can be provided to warn vehicles that are too large to exit the lane.

A speaker post is provided and contains a speaker and a microphone connected to a communication base system or to an order verification display (OVD) and/or an order confirmation board (OCB). In some designs, the OVD and speaker post can be integrated. A main menu board and other signage, such as manager's specials, are provided in close proximity to the speaker post and list the offerings. This speaker post can be broadly thought of as being a point of purchase interface.

It is desirable to provide a means for increasing the amount of signage at a point of purchase interface.

BRIEF DESCRIPTION OF THE DRAWING FIGURES

FIG. 8 is a front perspective view of an attachment clip used in the kit;

FIG. 9 is a front exploded perspective view of the attachment clip;

FIG. 10 is a top plan view of the attachment clip;

FIG. 11 is front elevation view of the attachment clip;

FIG. 11A is a cross-sectional view taken along the line D-D of FIG. 11;

FIG. 11B is a cross-sectional view taken along the line C-C of FIG. 11;

SUMMARY

Figure 1:
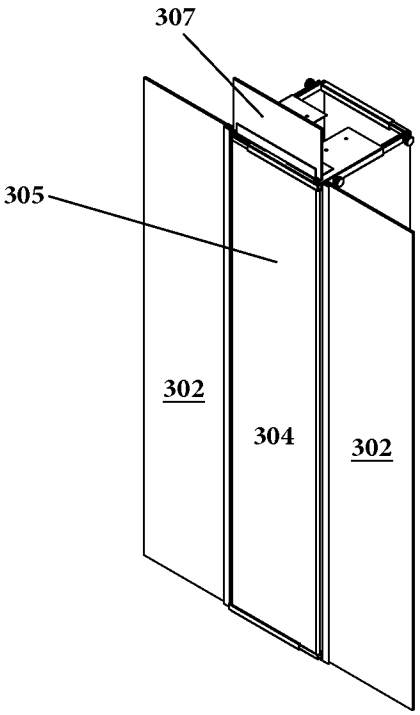
FIG. 1 is a perspective view of a universal signage kit for a point of purchase interface in an assembled state.

A signage frame kit for a point of purchase interface, such as a speaker post, is provided. The signage frame kit includes first and second supports for placement along two sides of the point of purchase interface. These first and second supports can expand and contract in a vertical direction along the sides of the point of purchase interface. Each of the first and second supports includes a first track and a second track. The first and second tracks extend outwardly (expand and contract) from a base portion of the respective support. In one embodiment, each of the first and second supports comprises a C-shaped structure with a C-shaped channel being defined in each of the first and second tracks as well as the base portion.

Mounting plates located along the first tracks are intended for mounting to a top of the point of purchase interface to securely fasten the frame kit to the point of purchase interface. The frame kit can be fastened using mechanical fasteners or magnetic elements to magnetically fasten the two.

The frame kit also includes a first pair of attachment clips that are detachably coupled to the first and second supports so as to position and retain the first and second supports relative to the point of purchase interface. Each attachment clip has a main section and a pair of legs that extend outwardly from the main section. The legs are configured for placement in one of the first and second tracks and are sized such that the first pair of attachment clips, in combination with the first and second supports, extends around a periphery of the point of purchase interface. The legs of the attachment clip are slidably received within one of the first and second tracks.

A plurality of fasteners is provided for securely locking the attachment clips in a desired location within one of the first and second tracks. Signage can be installed in each of the first and second supports.

DETAILED DESCRIPTION OF CERTAIN EMBODIMENTS

As mentioned herein, one element of a drive-thru is a speaker post (not shown) (or ordering kiosk) which contains a speaker and microphone to allow the consumer to easily place an order. A traditional speaker post is a vertical structure that is mounted to the ground and extends upwardly therefrom. The height of the speaker post is selected so that the speaker and microphone are positioned at an appropriate height relative to a window of a vehicle through which a person places the order. The speaker post can come in any number of different shapes; however, most speaker posts are square or rectangular shaped (however, they could be oval or circular as well, etc.).

The present invention is directed to a universal frame kit (assembly) 100 for a point of purchase interface, such as a speaker post. It will be understood that while the point of purchase interface is referenced herein as being a speaker post, it can be in other forms and the universal frame kit (assembly) 100 can be customized for such other uses, such as a kiosk or information display.

FIGS. 1-15 illustrate the universal frame kit 100 according to one exemplary embodiment of the present invention. The universal frame kit 100 is formed of a number of parts that are coupled to one another in relation to the point of purchase interface to form the assembled frame that is shown in FIG. 1. More specifically, the universal frame kit 100 generally includes a frame 200 and signage 300 that attaches to the frame 200.

The frame 200 includes a first frame support 210 and a second frame support 211. The first vertical support 210 can be thought of as being a left side vertical support, while the second vertical support 211 can be thought of as being a right side vertical support that is spaced from the left side vertical support 210. As described herein, the first and second vertical supports 210, 211 can be in the form of C-shaped brackets or the like. The two brackets 210, 211 are mirror images of one another and therefore, the individual parts thereof are numbered alike herein.

The left side vertical support 210 which comprises a C-shaped bracket has a top portion 212, an opposing bottom portion 220 and an intermediate portion 230. The top and bottom portions 212, 220 are at least substantially parallel to one another and the intermediate portion 230 serves to connect the top and bottom portions 210, 220 and is disposed at least substantially perpendicular to the top and bottom portions 212, 220. The top and bottom portions 212, 220 can be thought of as being tracks that extend outwardly from the intermediate portion 230 which can itself be thought of as being a base portion that contains a track.

The top portion 212 includes a top plate 214 and a first channel section 216. The first channel section 216 is in the form of an inner channel which is C-shaped. The first channel section 216 is oriented such that the opening of the C-shaped channel faces downward (see FIG. 6A) and thus, the intermediate base section that is formed between two legs provides a mounting or support surface for the top plate 214. Both ends of the first channel section 216 are open. As shown, the top plate 214 is mounted flush against the intermediate base section with a majority (e.g., a substantial portion) of the top plate 214 overhanging the first channel section 216. The top plate 214 is thus oriented parallel to the ground in this orientation and is perpendicular to the intermediate portion 230.

Figures 3, 4, 5, 6, 6A, 6B, 6C, 6D, 6E, 6F, 7:
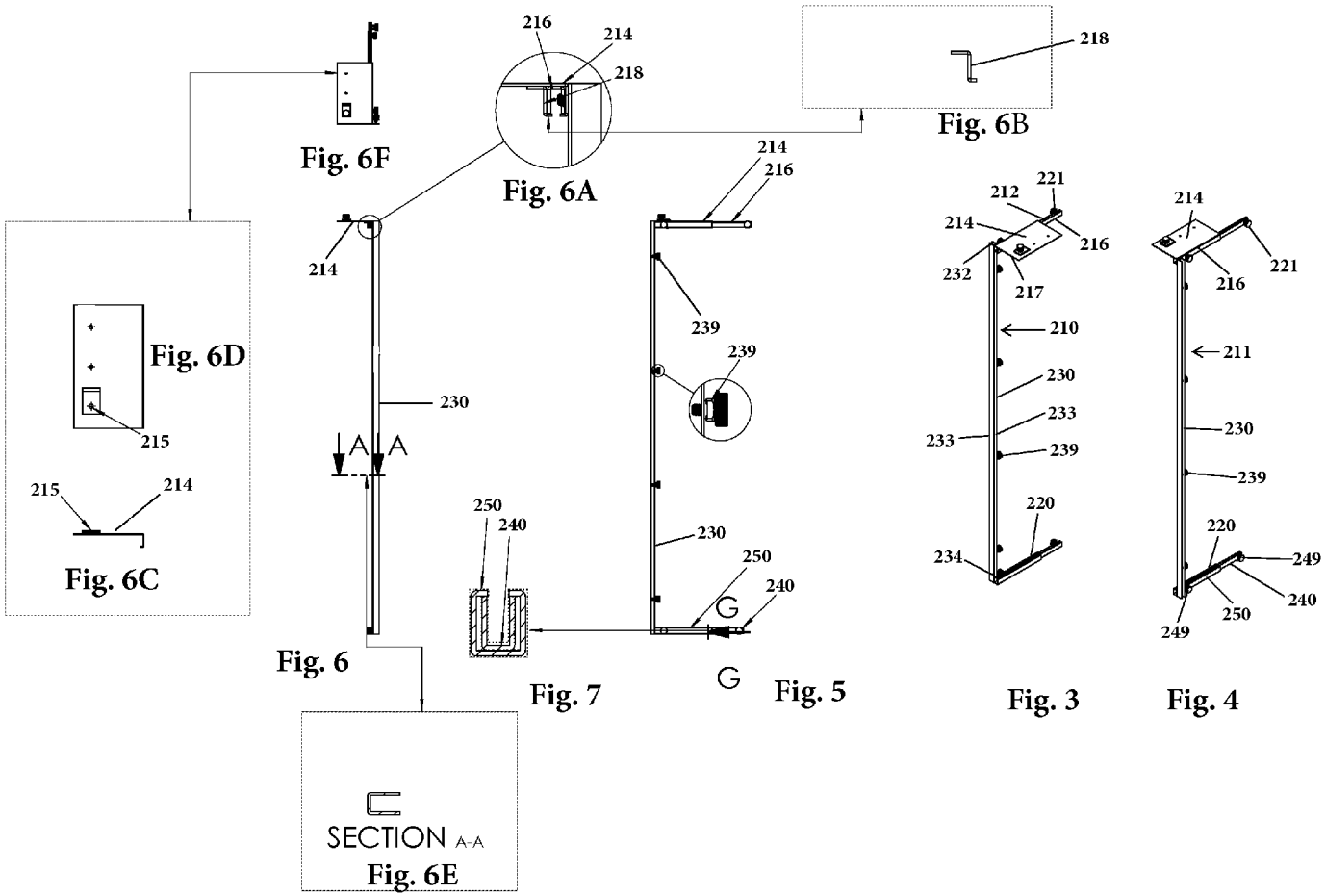
FIG. 3 is a perspective view of a left C-bracket of the kit of FIG. 1.
FIG. 4 is a perspective view of a right C-bracket of the kit of FIG. 1.
FIG. 5 is a right side elevation view of the right C-bracket.
FIG. 6 is a front elevation view of the right C-bracket.
FIG. 6A is an enlarged view of a top portion of the right C-bracket.
FIG. 6B is an enlarged view of an S-bracket used in the top portion.
FIG. 6C is a side view of a top plate including a tab.
FIG. 6D is a top plan view of the top plate.
FIG. 6E is a cross-sectional view taken along the line A-A of FIG. 6.
FIG. 6F is a top plan view of the right C-bracket.
FIG. 7 is a cross-sectional view taken along the line G-G of FIG. 5.
Figure 12:
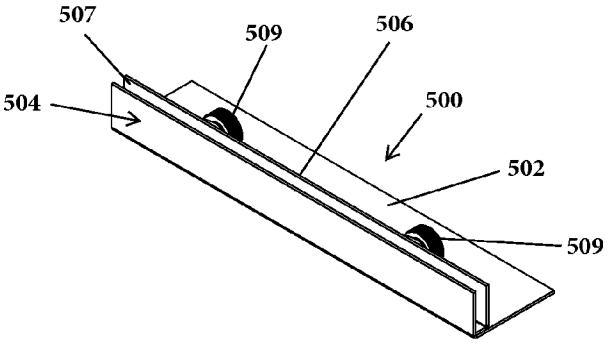
FIG. 12 is a front perspective view of a topper of the kit.
Figure 15:
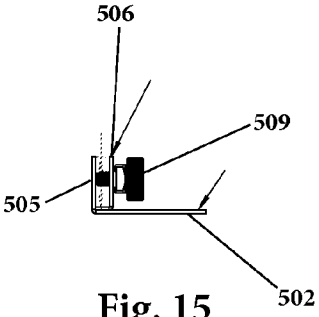
FIG. 15 is a right side elevation view of the topper.
Figure 14:
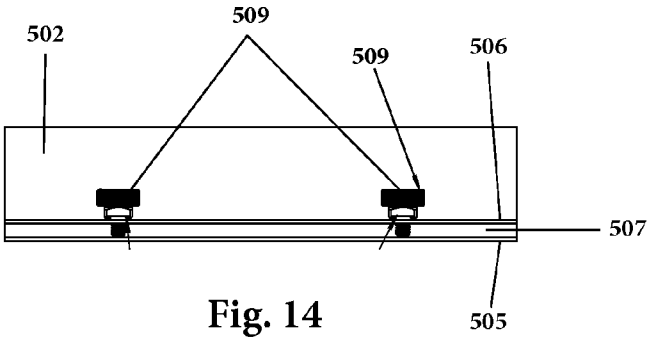
FIG. 14 is a top plan view of the topper.
Figure 13:
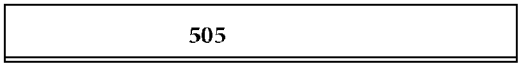
FIG. 13 is a front elevation view of the topper.

As shown in FIG. 6B, a bracket 218 can be used to attach the top portion 214 to the first channel section 216. The bracket 218 has an S-shape and one leg of the bracket 218 seats flush against and is attached to an underside of the top portion 214. Another portion of the bracket 218 seats flush against one leg of the C-shaped first channel section 216 and a small leg portion of the bracket 218 is in contact with a lower edge of the one leg of the C-shaped first channel section 216.

The top plate 214 can be thought of as having a front edge 217 and a rear edge 219. The front edge 217 is closer to the intermediate portion 230.

The top plate 214 includes a tab 215 as shown in FIG. 6C. The top plate 214 can take any number of different shapes including a rectangular shape as shown in the figures. However, the top plate 214 can take different forms including being square shaped and other shapes. The top plate 214 includes a plurality of holes that allow the top plate 214 to be mounted to a structure, such as a top surface of the speaker post. One of the holes can be located through the tab 215 and as shown, there can be three holes that are formed in a linear manner.

The C-shaped first channel section 216 can include adjustable fasteners 219 that pass through one leg into the open channel thereof to serve to secure an object within the first channel section 216. For example, the fasteners 219 can be in the form of thumb screws (plastic thumbs screws).

The intermediate portion 230 includes a first end 232 which is attached to the first channel section 216 and a second end 234 which is attached to the bottom portion 220. The intermediate portion 230 is also a C-shaped structure that is defined by a base section 231 which faces outwardly and a pair of legs 233 with a space therebetween. More particularly, the intermediate portion 230 is positioned such that the base section 231 is secured to one of the legs of the first channel section 216. As can be seen in FIG. 1, the open channel of the intermediate portion 230 can receive signage.

The inner leg of the intermediate portion 230 can include fasteners 239 for securing signage within the open channel of the intermediate portion 230. The fasteners 239 can be in the form of thumb screws or the like which when manipulated allow a force to be applied to the signage inserted into the open channel for gripping and holding the signage. The fasteners 239 thus face forward and since they pass through the inner leg, they are not visible after installation. The outer leg faces outward toward the consumer.

The bottom portion 220 has a construction that is different than the top portion 210. The bottom portion 220 does have a C-shape; however, the bottom portion 220 is formed of an inner channel member 240 and an outer channel member 250. Each of the inner channel member 240 and the outer channel member 250 has a C-shape and the inner channel member 240 is nested within the outer channel member 250. As shown in FIG. 7, the free ends of the legs of the outer channel member 250 can include lips or inwardly directed flanges 252 that extend over the free ends of the legs of the inner channel member 240. These lips 252 thus serve to securely contain the inner channel member 240 within the outer channel member 250. The inner channel member 240 can move relative to the outer channel member 250 in that the inner channel member 240 can slide within the outer channel member 250 (this allows the overall length of the bottom portion 220 to vary to accommodate different sized point of purchase interfaces). As shown in FIGS. 3 and 4, the inner channel member 240 extends beyond the distal end of the outer channel member 250. Both the inner channel member 240 and the outer channel member 250 are open at both ends thereof to allow insertion of an object at each end of the combined channel structure.

The bottom portion 220 also includes a plurality of fasteners 249 for engaging and holding signage within the open channel formed therein. As shown in the figures, at least one fastener 249 passes through the inner channel member 240 and at least one fastener 249 passes through the outer channel member 250.

The bottom portion 220 is positioned relative to the intermediate portion 230 in the same manner as the C-shaped first channel section 216. More specifically, both the bottom portion 220 and the C-shaped first channel section 216 are located along the same side of the intermediate portion 230. The inner channel member 240 and the outer channel member 250 are oriented such that the open channels thereof face upward. The open channels of the first channel section 216 and the inner channel member 240 and the outer channel member 250 face one another.

As shown in the figures, the first and second vertical supports 210, 211 are intended for placement on opposite sides of the point of purchase interface (speaker post). The first and second vertical supports 210, 211 are oriented such that the top plates 214 of each face inwardly towards one another. The two top plates 214 thus overlie and are secured to the top of the point of purchase interface (e.g., speaker post). The holes located in each top plate 214 are formed along edges that face one another and are positioned centrally relative to the point of purchase interface so as to allow the first and second vertical supports 210, 211 to be securely fixed to the point of purchase interface.

FIGS. 8-11 illustrate an attachment clip 400 for use in the kit. In particular, the kit includes a plurality of attachment clips 400 for use in attaching the first and second vertical supports 210, 211 to the point of purchase interface. In the illustrated embodiment, there are four attachment clips 400 that are used. FIG. 8 shows one attachment clip 400 in an assembled position, while FIG. 9 shows the attachment clip 400 prior to assembly. The attachment clip 400 is formed of an inner channel piece 410 and an outer channel piece 420. Each of the inner channel piece 410 and the outer channel piece 420 has an L-shape.

The outer channel piece 420 has a first section 422 and a second section 424. As shown, the first section 422 is intended for placement in either the front or the rear of the point of purchase interface, while the second section 424 is intended for placement along the side of the point of purchase interface. The second section 424 is in the form of a thin rail (e.g., a leg) that is formed perpendicular to the first section (e.g. a main section or base section) 422. The second section 424 has a rectangular shape. As shown in FIG. 11B, the first section 422 is generally U-shaped and is defined by a top wall 425 and a pair of opposing side walls 426 that connect to the top wall 425. Each of the free ends of the side walls 426 includes a lip 429 that faces inward. The two lips 429 that face one another thus serve to partially close off the inner space formed between the side walls 426.

The second section 424 has a length that is less than the first section 422.

The inner channel piece 410 has a first section 412 and a second section 414. As shown, the first section 412 is intended for placement in either the front or the rear of the point of purchase interface, while the second section 414 is intended for placement along the side of the point of purchase interface. The second section 414 is in the form of a thin rail (leg) that is formed perpendicular to the first section 412. The second section 414 has a rectangular shape. As shown in FIG. 11A, the first section 412 is generally U-shaped and is defined by a top wall 415 and a pair of opposing side walls 416 that connect to the top wall 415. The second section 414 has a length that is less than the first section 412.

In one embodiment, the second sections (legs) 414, 424 have a length that is about 3 inches, while each of the first sections 412, 422 has a length that is about 8 inches.

As shown in FIGS. 8 and 10, the U-shaped structures of the first sections 412, 422 do not intersect the respective second sections 414, 424 in that a gap 430 is formed between each of the first sections 412, 422 and the respective U-shaped structure of the second sections 414, 424. In the illustrated embodiment, the gap 430 comprises a ¼ inch gap.

As shown in FIGS. 8 and 10, the U-shaped first section 412 of the inner channel piece 410 is received within the U-shaped first section 422 of the outer channel piece 420 so as to allow the two first sections 412, 422 (which are parallel to one another) to be positioned a predetermined distance apart from one another. In other words, when mated together, the inner channel piece 410 and the outer channel piece 420 represent a rail within a rail configuration and the channel openings of each both face downwardly.

The kit can also include a topper 500 which is configured to be disposed along the top of the point of purchase interface. As shown in FIGS. 12-15, the topper 500 is generally in the form of a bracket and more specifically, an L-shaped bracket. The topper 500 is defined by a base wall 502 and a vertical part 504 which extends upwardly therefrom. A right angle is formed between the base wall 502 and the vertical part 504. The vertical part 504 is formed of pair of vertical walls, namely, a first vertical wall 505 and a second vertical wall 506. The two vertical walls 505, 506 are parallel to one another with a space 507 formed therebetween. The space 507 is designed to receive signage.

The vertical wall 505 can be thought of as being a forward wall, while the vertical wall 506 can be thought of as being a rear wall. The forward vertical wall 505 is thus formed at the front edge of the base wall 502. The rear vertical wall 506 includes a number of fasteners 509 that pass therethrough and are intended to engage and hold the signage in place within the space (slot) 507. The fasteners 509 can be in the form of plastic thumb screws that when tightened, apply a force to the signage that is located within the slot 507. In the illustrated embodiment there are two thumb screws 509.

The assembly of the kit 100 relative to the point of purchase interface will now be discussed with reference to FIGS. 1-15. As mentioned, the first vertical support 210 is positioned on the left side of the point of purchase interface and the second vertical support 211 is placed on the right side of the point of purchase interface with the top plates 214 thereof being positioned on the top of the point of purchase interface. The first channel sections 216 extend along the two sides of the point of purchase interface near the top thereof and similarly, the bottom portions 220 extend along the two sides of the point of purchase interface. As mentioned previously, fasteners pass through the top plates 214 to securely attach the first and second vertical supports 210, 211 to the point of purchase interface.

In an alternative embodiment, the coupling between the top plate 214 and the point of purchase interface can be a releasable magnetic connection. More specifically, the top plate 214 can be formed of a magnetic material or the top plate 214 can includes one or more magnets coupled thereto. Most point of purchase interfaces are formed of metal and thus, the top plate 214 is magnetically coupled to the point of purchase interface due to the magnetic attraction between the top plate 214 and the point of purchase interface. When magnetic attraction is used as the mechanism for coupling the top plate 214 to the point of purchase interface, fasteners can be eliminated.

The frame of the kit 100 is additionally secured to the point of purchase interface using the attachment clips 400. As shown in the figures, four (4) attachment clips 400 can be used to further attach the first and second vertical supports 210, 211. More specifically, two attachment clips 400 are used at the top of the point of purchase interface and two attachment clips 400 are used at the bottom of the point of purchase interface.

Two (2) attachment clips 400 are used in conjunction with the C-shaped channel section 216 of each of the first and second vertical supports 210, 211. In other words, one attachment clip 400 is inserted into a forward end of the C-shaped channel section 216 of each of the first and second vertical supports 210, 211. The second sections 414, 424 of the attachment clip 400 are inserted into the open forward ends of the C-shaped channel sections 216. Fasteners 221 are used to securely attach the attachment clip 400 to the forward section of the C-shaped channel section 216. More specifically, when the illustrated thumb screws 221 are tightened, the screws 221 are driven into intimate contact with and apply a force against the second sections 414, 424 of the attachment clip 400. This results in one attachment clip 400 being securely attached to the front of the point of purchase interface. Similarly, another attachment clip 400 is inserted into a rear end of the C-shaped channel section 216 of each of the first and second vertical supports 210, 211. The second sections 414, 424 of the other attachment clip 400 are inserted into the open rear ends of the C-shaped channel sections 216. Fasteners 221 are used to securely attach the attachment clip 400 to the rear section of the C-shaped channel section 216. More specifically, when the illustrated thumb screws 221 are tightened, the screws 221 are driven into intimate contact with and apply a force against the second sections 414, 424 of the other attachment clip 400. This results in one attachment clip 400 being securely positioned along the rear of the point of purchase interface.

In the same manner, the two attachment clips 400 are attached to the bottom portions 220. One attachment clip 400 is inserted into a forward end of the outer channel 250 of each of the first and second vertical supports 210, 211. The second sections 414, 424 of the attachment clip 400 are inserted into the open forward ends of the outer channels 250. Fasteners 249 are used to securely attach the attachment clip 400 to the forward section of the outer channels 250. More specifically, when the illustrated thumb screws 249 are tightened, the screws 249 are driven into intimate contact with and apply a force against the second sections 414, 424 of the attachment clip 400. This results in one attachment clip 400 being securely positioned along the front of the point of purchase interface. Similarly, another attachment clip 400 is inserted into a rear end of the inner channel 240 of each of the first and second vertical supports 210, 211. The second sections 414, 424 of the other attachment clip 400 are inserted into the open rear ends of the inner channels 240 of the first and second vertical supports 210, 211. Fasteners 221 are used to securely attach the attachment clip 400 to the rear section of the C-shaped channel section 216. More specifically, when the illustrated thumb screws 249 are tightened, the screws 249 are driven into intimate contact with and apply a force against the second sections 414, 424 of the other attachment clip 400. This results in one attachment clip 400 being securely positioned along the rear of the point of purchase interface.

It will be understood that prior to coupling the attachments clips 400 to the C-shaped channel sections 216, the width of each attachment clip 400 is adjusted by moving the inner channel member 410 within the outer channel member 420.

Figure 2:
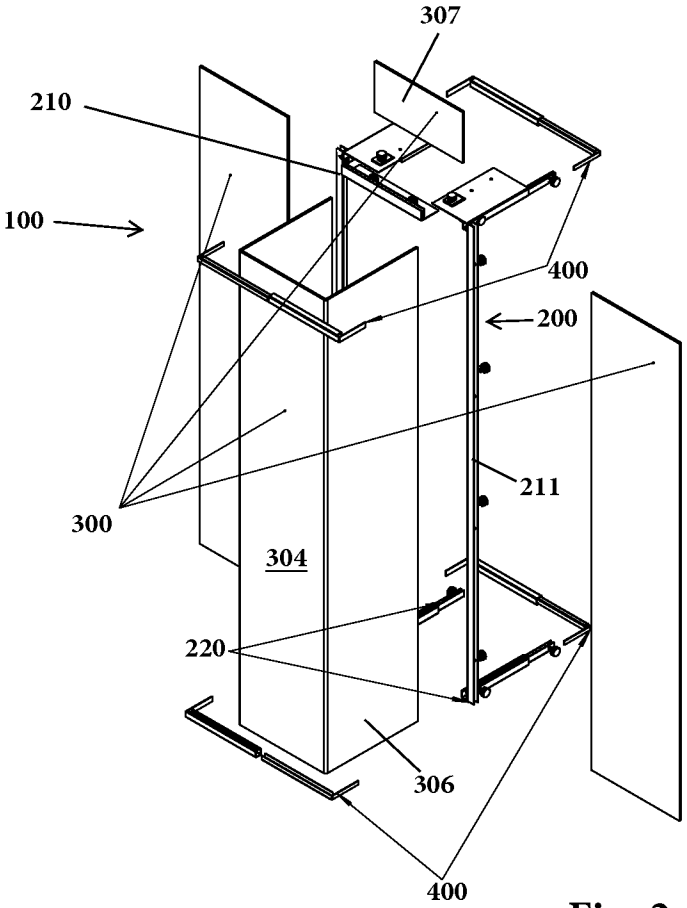
FIG. 2 is an exploded perspective view of the kit of FIG. 1.

As shown in FIGS. 1 and 2, there are four attachment clips 400 used to secure the frame of the kit 100 to the point of purchase interface. It will be appreciated that, as mentioned above, each attachment clip 400 can be adjusted so as to accommodate different sized point of purchase interfaces and further the open track nature of the receiving channels formed at both the top and the bottom of the frame accommodate different sized point of purchase interfaces since the legs (second sections) of the attachment clips can slidably travel within the respective channels and be locked in certain places using the fasteners (thumb screws). In other words, the degree at which the attachment clips 400 are inserted into the respective channels can be selected depending upon the characteristics (properties) of the point of purchase interface (i.e., the size of the point of purchase interface). These fitting features thus allow the kit 100 to be retrofitted to any number of different types of existing point of purchase interfaces (e.g., existing speaker posts).

As shown in the figures, when the top pair of attachment clips 400 is combined with the channel sections 216, they define a square shaped frame structure that extends around the periphery of the point of purchase interface. When the bottom pair of attachment clips 400 is combined with the inner channel member 410 and the outer channel member 420, they also define a square shaped frame structure that extends around the periphery of the point of purchase interface.

The topper 500 can be an optional accessory that is mounted to the top or above the top of the point of purchase interface. For example, the base 502 of the topper 500 can be mounted to the top plates 214 or to the point of purchase interface so as to position the forward section 505 at or near the front of the point of purchase interface.

Signage 300 can be installed in multiple locations as shown in FIGS. 1 and 2. The frame kit 100 includes a number of channels, as described herein, that can receive the signage 300 and the respective fasteners associated with the channels provide a means for securely holding the signage in place within the respective channels. For example, the open channel formed between the legs 233 of the intermediate portion 230 can receive signage 302 (e.g., a flat plastic sign) and since this open channel faces outward, the signage 302 extends outward and is positioned perpendicular to the side of the point of purchase interface. Fasteners 239 are used to secure the signage in place. It will be understood that more than one sign 302 can be disposed within this open channel.

Each of the first and second vertical supports 210, 211 includes such a channel, thereby allowing two attachment points (areas) for the signage 302. As shown in FIG. 1, when signage is placed in both channels, the signage 302 is located in the same plane and extends outwardly from opposing sides of the point of purchase interface.

A front piece of signage 304 can also be provided and is constructed to be disposed along the front of the point of purchase interface. In the illustrated embodiment, the signage 304 includes a U-shaped sign that is defined by a front wall 305 and a pair of side walls 306. The side walls 306 provide the means for anchoring the signage 304 to the frame of the kit 100. In particular, the side walls 306 are inserted into the downwardly facing channel formed in the channel section 216 in the top portion of the frame and the upwardly facing channel section formed in the inner channel 240 of the bottom portion of the frame. In particular, the top edges of the side walls 306 are received within the respective channel sections 216 and similarly, the bottom edges of the side walls 306 are received within the inner channels 240, this results in locking of the signage 304 in the frame. The front portion of the signage 304 extends in front of the point of purchase interface (speaker post). The front portion can include an opening to accommodate the speaker (so as to leave the speaker uncovered).

Additional signage 307 can be added to the topper 500. The signage 307 can be inserted into the slot 507 and the fasteners 509 are used to secure the signage 305 within the topper 500. The signage 307 is positioned above the top of the point of purchase interface.

The signage 302, 304, 305 can all lie within the same plane as shown when installed in the frame. This provides a clean fit and appearance.

It will be appreciate that the fasteners associated with the frame allow for the signage to be easily changed. Any number of different types of signage can be used including advertising based signage, informational signage, such as menu boards, etc. While the point of purchase interface can be at a retail drive through, it can also be part of a kiosk type setting.

As mentioned, the signage at any of the illustrated locations can be formed of a plurality of signs that are stacked, etc.

It will further be appreciated that a locking mechanism can be incorporated in the frame so as to prevent undesired removal of the signage. For example, a lock mechanism can be incorporated into one or more of the fasteners or a separate lock can be incorporated into the design to prevent removal of the signage. The lock can include a key mechanism, such as one which prevents unlocking and removal of the fastener.

While the frame is shown as containing vertical support members that have channel structure at both the top and bottom, it will be appreciated that the frame kit could include only one of the channel structures (e.g., at either the top and bottom channels). The use of two channel structures and two pairs of attachment clips adds increased stability and additional attachment points and thus is preferred.

In addition, the channel structures discussed herein can also be thought of as being track members that define one or more tracks that receive an object, such as signage or the attachment clips or other structures.

It will be understood that the kit 100 can be provided in a single package (box) with the necessary components to allow for mounting to the point of purchase interface. In particular and as mentioned herein, the kit 100 is intended to be universal in that the kit 100 can be installed on a variety of existing point of purchase interfaces. In particular, the adjustability of both the vertical supports and the attachment clips allow for the frame to be installed on a variety of different shaped point of purchase interfaces (e.g., point of purchase interfaces that have different sizes and shapes, etc.).

The frame kit of the present invention offers a means for easily increasing the amount of signage at the point of purchase interface without having to make structural changes to the actual point of purchase interface. The number of signs (e.g., advertisements) and the shapes and sizes thereof can be selected by the user based on different parameters such as spacing considerations and the type of retail establishment, etc.

Since the bottom channel structures (inner channel 240/ outer channel 250) are disposed alongside the sides of the point of purchase interface, the frame kit can be used with point of purchase interfaces that have different heights. The mounting plates 214 do close off the inner space of the frame kit and thus, the mounting plates 214 must be placed along the top or above the point of purchase interface. However, the design and mating between the attachment clips and the bottom channel structures of the two vertical supports allow for attachment of the bottom of the frame kit at a variety of locations. In other words, the bottom attachment clips do not have to be at the ground surface but instead can be spaced some distance from the ground surface. Since the bottom channels do carry the signage, it is preferred that the bottom channel and bottom attachment clips be located as close to the ground surface as possible so as to avoid any unsightly gaps between the bottom of the signage and the ground surface.

In one embodiment, the frame is thus configured to be placed along three sides of the point of purchase interface and thus, offers constraint along these three sides. In addition, the piece of signage can be a foldable structure that a main front portion and two side portions that fold relative to the main front portion and along a pair of fold lines. As described herein, the edges of the first piece of signage are received within respective channels (tracks) to secure the first piece of signage to the frame. Once assembled, the first piece of signage is thus positioned along the front and two opposing sides of the point of purchase interface. As a result of the folding nature, the construction of the first piece of signage allows for the use of a single piece of signage as opposed to three separate articles of signage.

It will be appreciated that the various parts of the present kit can be formed of materials that are suitable for the intended application and in particular, can be made typically of plastics and/or metals. The signage is made of appropriate materials as well depending upon the location of the intended application, (i.e., outside or not) and typically, the signs are plastics sheets (films).

While the present invention has been described above using specific embodiments, there are many variations and modifications that will be apparent to those having ordinary skill in the art. As such, the described embodiments are to be considered in all respects as illustrative, and not restrictive. Therefore, the scope of the invention is indicated by the appended claims, rather than by the foregoing description. All changes that come within the meaning and range of equivalency of the claims are to be embraced within their scope.

What is claimed is:

1. A signage frame kit for a point of purchase interface comprising:

first and second frame supports for placement along two sides of the point of purchase interface, wherein each of the first and second frame supports includes a first track and a second track, each of the first and second tracks extending outwardly from a base portion of the respective frame support, wherein each of the first and second tracks has an adjustable length;

a first pair of attachment clips detachably coupled to the first and second supports, each attachment clip having a main section and a pair of legs extending outwardly from the main section, the legs for placement in one of the first and second tracks and being sized such that the first pair of attachment clips, in combination with the first and second supports, extend around a periphery of the point of purchase interface, wherein the legs of the attachment clip are slidably received within one of the first and second tracks; and a plurality of fasteners for securely locking the attachment clips in a desired location within one of the first and second tracks;

wherein each of the first and second frame supports is configured to receive signage.

2. The frame kit of claim 1, wherein the first and second frame supports comprise vertical supports and the first and second tracks comprise horizontal tracks that are normal to the respective vertical support.

3. The frame kit of claim 1, wherein each of the first and second frame supports comprises a C-shaped bracket such that the base portion and each of the first and second tracks comprise C-shaped structures.

4. The frame kit of claim 1, wherein each of the first and second frame support includes a mounting plate for secure attachment to a top of the point of purchase interface.

5. The frame kit of claim 4, wherein the mounting plate comprises a flat plate that is mounted to a top surface of the first track.

6. The frame kit of claim 1, wherein each end of each of the first and second tracks is open to allow legs of one attachment clip to be slidably received.

7. The frame kit of claim 1, wherein the base portion of each of the first and second frame supports includes a first C-shaped channel, the first track includes a second C-shaped channel and the second track includes a third C-shaped channel, the first track being formed at an upper end of the respective frame support and the second track being formed at a lower end of the respective frame support.

8. The frame kit of claim 7, wherein the first C-shaped channel faces and is open in an outward direction relative to the point of purchase interface, wherein each of the first, second and third C-shaped channels includes at least two fasteners.

9. The frame kit of claim 7, wherein the second C-shaped channel is open in a downward direction and the third C-shaped channel is open in an upward direction such that the openings of the second and third C-shaped channels face one another.

10. The frame kit of claim 1, wherein the second track comprises an outer C-shaped channel structure and an inner C-shaped channel structure, the inner C-shaped channel structure being slidably received within the outer C-shaped channel structure.

11. The frame kit of claim 1, wherein each of the first and second supports and each of the attachment clips has a U-shape.

12. The frame kit of claim 1, wherein there are two pairs of attachment clips with one pair of attachment clips being inserted into the first track and the other pair of attachment clips being inserted into the second track.

13. The frame kit of claim 12, wherein a first attachment clip of the one pair is inserted into a front end of the first track and a second attachment clip of the one pair is inserted into a back end of the first track and a first attachment clip of the other pair is inserted into a front end of the second track and a second attachment clip of the other pair is inserted into a back end of the second track.

14. The frame kit of claim 1, further including a topper that includes a slot for receiving a sign and has a base surface for attachment to one of the point of purchase interface and the first and second supports.

15. The frame kit of claim 14, wherein the slot opens upwardly.

16. A signage frame kit for a point of purchase interface comprising:

first and second C-shaped frame supports for placement along two sides of the point of purchase interface, wherein each of the first and second C-shaped frame supports includes a first C-shaped track, a second C-shaped track and an intermediate portion between the first and second C-shaped tracks, the intermediate portion defining a third C-shaped track and each of the first and second C-shaped tracks extend outwardly from the third C-shaped track, wherein each of the first, second and third C-shaped tracks is configured to receive signage;

first and second pairs of attachment clips detachably coupled to the first and second C-shaped frame supports so as to position the first and second C-shaped frame supports relative to the point of purchase interface, each attachment clip having a main section and a pair of legs extending outwardly from the main section, wherein the legs of the first pair of attachments clips are slidably received within open ends of the first C-shaped tracks of the first and second C-shaped frame supports and the legs of the second pair of attachment clips are slidably received within open ends of the second C-shaped tracks of the first and second C-shaped frame supports; and a plurality of fasteners for securely locking the attachment clips in a desired location within one of the respective first and second C-shaped tracks.

17. The frame kit of claim 16, wherein each attachment clip comprises an inner channel member and an outer channel member, one leg extending outwardly from one end of a first section of the inner channel member and the other leg extending outwardly from one end of a first section of the outer channel member, the first section of the inner channel member being slidably received within the first section of the outer channel member to permit a length of the combined first sections and a distance between the legs to be varied.

18. The frame kit of claim 16, wherein each of the first and second C-shaped frame supports includes a mounting plate that extends inwardly from the first C-shaped track, the mounting plate being configured for attachment to a top of the point of purchase interface.

19. The frame kit of claim 16, wherein openings of the first C-shaped tracks of the first and second C-shaped frame supports face downward; openings of the second C-shaped tracks of the first and second C-shaped frame supports face upward toward the openings of the first C-shaped tracks; and openings of third C-shaped tracks of the first and second C-shaped frame supports face outward relative to the point of purchase interface.

20. The frame kit of claim 1, wherein the signage includes a pair of first signs that are received in the third C-shaped tracks, a second sign that has a U-shape with side walls being received within both the first and second C-shaped tracks.

21. The frame kit of claim 20, wherein a front portion of the second sign is disposed along a front of the point of purchase interface, wherein the fasteners associated with the first and second C-shaped tracks apply a force to the second sign to hold the second sign in place.

22. The frame kit of claim 20, wherein fasteners within and located along the third C-shaped tracks apply a force to the first signs to hold the first signs in place.

23. The frame kit of claim 20, further including a topper that includes a slot for receiving a fourth sign and has a base surface for attachment to one of the point of purchase interface and the first and second C-shaped supports.

24. The frame kit of claim 23, wherein the first signs, the front portion of the second sign, the third sign and the fourth sign are disposed at least substantially within the same plane.

25. A signage frame kit for a point of purchase interface comprising:

first and second channeled frame supports for placement along two sides of the point of purchase interface, wherein each of the first and second channeled frame supports includes a first track, a second track and an intermediate portion between the first and second tracks, each of the first and second tracks extending outwardly from the intermediate portion which includes a third track, wherein each of the first, second and third tracks is configured to receive signage and where the second track has an adjustable length;

first and second pairs of attachment clips detachably coupled to the first and second channeled frame supports so as to position the first and second channeled frame supports relative to the point of purchase interface, each attachment clip having a main section and a pair of legs extending outwardly from the main section and each attachment clip has an adjustable length to allows a distance between the pair of legs to be varied, wherein the legs of the first pair of attachments clips are slidably received within open ends of the first tracks of the first and second channeled frame supports and the legs of the second pair of attachment clips are slidably received within open ends of the second tracks of the first and second channeled frame supports; and a plurality of fasteners for securely locking the attachment clips in a desired location within one of the respective first and second tracks.

26. A signage frame kit for a point of purchase interface having four sides comprising:

first and second frame supports for placement along first and second sides of the point of purchase interface, wherein each of the first and second frame supports includes a first track and a second track, each of the first and second tracks extending outwardly from a base portion of the respective frame support, wherein each of the first and second tracks has an adjustable length;

a first pair of attachment clips wherein each attachment clip is received within one pair of first and second tracks and secured thereto so as to be disposed along a third side of the point of purchase interface a first piece of signage that has a front portion that covers a fourth side of the point of purchase interface and first and second side portions that cover the first and second sides of the point of purchase interface, the first and second side portion being delineated from the front portion by a pair of fold lines about which the first piece of signage is folded.

* * * * *